US006773341B2

(12) United States Patent
Cedergreen et al.

(10) Patent No.: US 6,773,341 B2
(45) Date of Patent: Aug. 10, 2004

(54) VENTILATING DEVICE FOR VENTILATING THROUGH A RIDGE

(76) Inventors: Christian Cedergreen, Hornshøjparken 2C, DK-7500 Holstebro (DK); Kenneth Olsen, Krikvej 7, DK-7700 Vestervig (DK)

( * ) Notice: Subject to any disclaimer, the term of this patent is extended or adjusted under 35 U.S.C. 154(b) by 0 days.

(21) Appl. No.: 10/165,752

(22) Filed: Jun. 7, 2002

(65) Prior Publication Data

US 2002/0187744 A1 Dec. 12, 2002

Related U.S. Application Data

(63) Continuation of application No. PCT/DK00/00668, filed on Dec. 6, 2000.

(30) Foreign Application Priority Data

Dec. 9, 1999 (DK) ..... BA 1999 00439

(51) Int. Cl.[7] ..... F24F 7/02

(52) U.S. Cl. ..... 454/365; 454/366; 52/198; 52/199

(58) Field of Search ..... 454/365, 366; 52/198, 199

(56) References Cited

U.S. PATENT DOCUMENTS

| | | | | |
|---|---|---|---|---|
| 1,717,128 A | | 6/1929 | Moore | |
| 3,874,138 A | * | 4/1975 | Storch | 52/199 |
| 4,558,637 A | * | 12/1985 | Mason | 454/365 |
| 4,685,265 A | * | 8/1987 | Cooper | 52/277 |
| 5,326,318 A | | 7/1994 | Rotter | 454/365 |
| 5,339,582 A | | 8/1994 | Sells | 52/198 |
| 6,015,343 A | * | 1/2000 | Castillo et al. | 454/365 |
| 6,128,870 A | * | 10/2000 | Kohler | 52/199 |
| 6,267,668 B1 | * | 7/2001 | Morris | 454/365 |
| 6,286,273 B1 | * | 9/2001 | Villela et al. | 52/199 |

FOREIGN PATENT DOCUMENTS

| | | | |
|---|---|---|---|
| EP | 0113182 A1 | 7/1984 | E04D/1/34 |
| GB | 2 204 339 | 11/1988 | E04D/13/16 |
| GB | 2 338 001 | 12/1999 | E04D/1/30 |
| JP | 08068178 | 3/1996 | E04D/013/16 |
| WO | WO 97/35080 | 9/1997 | E04D/1/36 |

* cited by examiner

*Primary Examiner*—Derek Boles
(74) *Attorney, Agent, or Firm*—Klein, O'Neill & Singh, LLP; Howard J. Klein

(57) ABSTRACT

A ventilating device for ventilating through a ridge, preferably through a top ridge of a roof, includes a ridge member configured extending longitudinally along and beneath the ridge. The ridge member has a rigid part that includes two opposed panels and a number of cross pieces extending between the opposing panels. The ridge member also has passages extending from a lower part of the ridge member to an upper part of the ridge member. In a first embodiment, the cross pieces extend from the lower part to the upper part of the ridge member transverse to a longitudinal direction of the ridge member, and ventilating passages are formed in spaces between the two opposing panels and between the cross pieces. In a second embodiment, the cross pieces extend between the lower part of the ridge member to the upper part of the ridge member parallel to a longitudinal direction of the ridge member, and ventilating passages are formed as holes penetrating the cross pieces. In both embodiments, the ventilating passages allow air to pass from the lower part of the ridge member, along the ventilating passages, to the upper part of the ridge member.

22 Claims, 15 Drawing Sheets

VENTILATING DEVICE FOR VENTILATING THROUGH A RIDGE

CROSS-REFERENCE TO RELATED APPLICATION

Figure 1A:
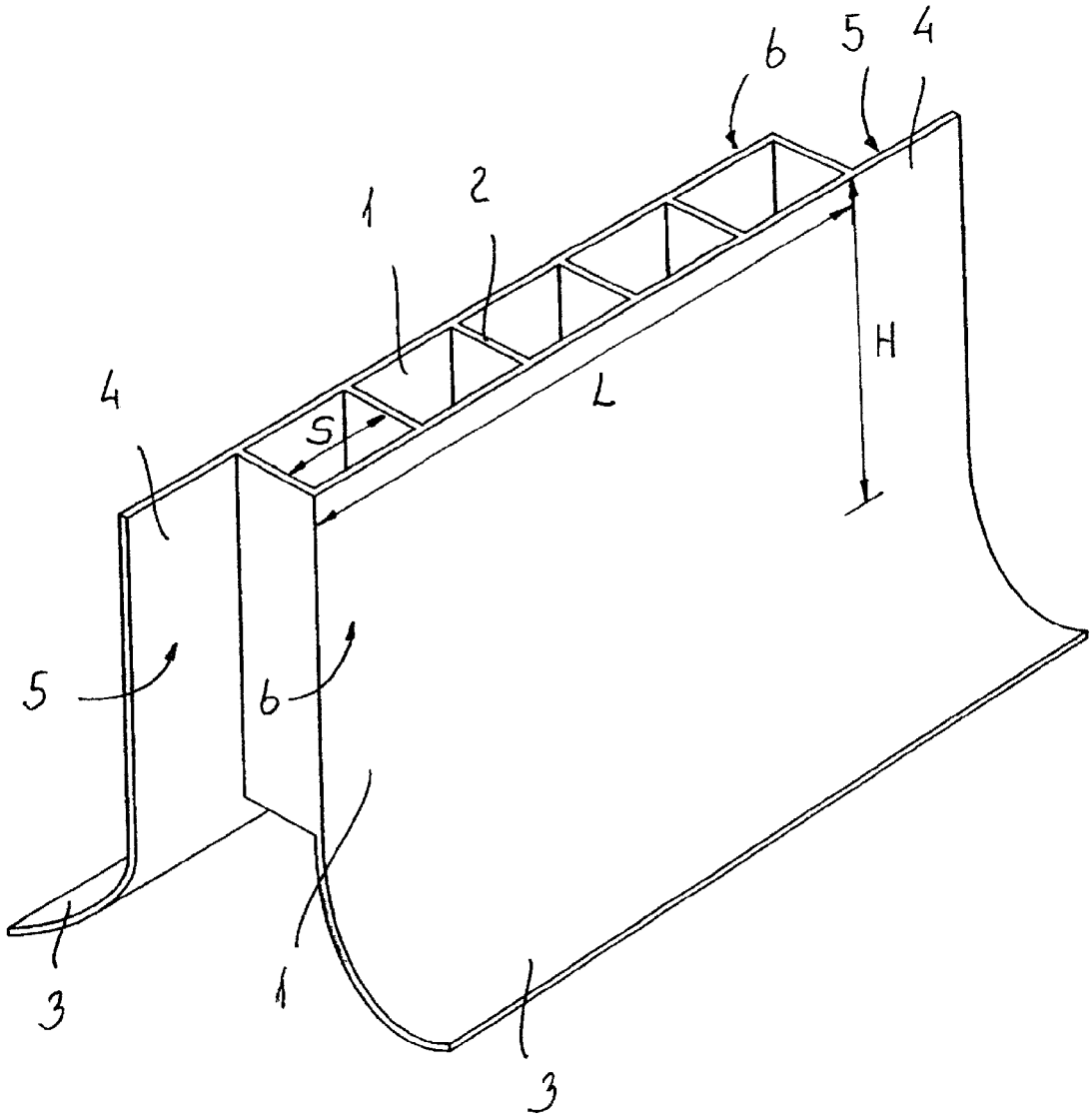

This application is a Continuation of co-pending International Application No. PCT/DK00/00668; filed Dec. 6, 2000.

The present invention relates to a ventilating device for ventilating through a ridge, preferably through a top ridge of a roof.

U.S. Pat. No. 5,921,863 describes a ventilating device for a roof. In one embodiment the device has venting material comprising courses or plies of a corrugated material, which defines passages communicating vent openings at the lower part of the venting material with the ambient atmosphere through the passages defined by the corrugated material and openings defined between cap tiles and roofing tiles. In another embodiment the device has a member consisting of vertical side panels individually spaced and mutually connected by a top edge. The member also has diverging legs extending downward from the side panels and being secured to an underlayment. Each of the side panels is provided with louvers for providing a venting passage from a lower part of the member to a space between the side panels and through the louvers in the side panels. Roof tiles are mounted to the top edge by securing the roof tiles to the top edge by means of screws or nails. Apart from the ventilating material and the ventilating member the ventilating device is also provided with movable members functioning as baffles and which may deflect between an open and inactive position and a closed and active position. The movable members are intended for preventing wind driven moisture from entering the interior of the roof construction.

The above ventilating device has however some disadvantages. The ventilating device comprises passages for air from the roof construction to the ambient atmosphere, which passages are dependent of the air having to be directed through either louvers or baffles underneath the cap tiles. The provision of baffles and the use of corrugated passages or louvers through which the air must pass is an advantage for preventing wind driven moisture from entering the roof construction. However, the possibility of the air from within the roof construction passing to the ambient atmosphere is very limited by use of baffles, corrugated passages or louvers. There is a severe risk that the passage of air is so limited that the air within the roof construction will not escape. This will lead to damages of the roof construction due to the entrapment of humid air with moisture from the house.

SUMMARY OF THE INVENTION

It is an object of the present invention to eliminate the above mentioned disadvantages and to provide a ventilating device that is capable of sufficiently ventilating the roof construction without any risk of moisture from the house being captured along ridges of the roof construction, but at the same time ensuring that wind driven moisture such as dew or snow will not enter the roof construction.

This object is obtained by a ventilating device where said ridge member having passages extending from a lower part of the ridge member to an upper part of the ridge member, said upper part being an uppermost part of the ridge member.

By providing passages extending all the way to the uppermost part of the ridge member of the ridge member it is obtained that the moisture in the humid air is effectively and safely passed to the ambient atmosphere. The passage led directly upwards to the ridge of the roof and the humid air do not have to pass bends through louvers, through corrugated passages or through baffles. By passing the humid air to an uppermost part of the ridge member, preferably as far as possible to the very ridge of the roof the risk is very limited of wind driven moisture entering the roof construction.

Also, surprisingly with a building element such as a ventilating device, even a chimney effect is obtained by the present invention when the humid air is passed as unhindered as possible through the ventilating device and when the upper part of the ridge member of the ventilating device constitutes the uppermost part of the ventilating device. Thus, not only is the humid air allowed to pass to the ridge member and further on unhindered through the ventilating device, but also the chimney effect will further enhance the ventilating of the underroof by actually drawing the humid air through the ventilating device. The draw that is established in the ventilating device according to the invention creates an overpressure. This overpressure further limits the risk of wind driven moisture such as snow or dew from entering the interior of the roof construction.

In a first embodiment of the invention the ventilating device said cross pieces extend from the lower part to the upper part of the ridge member transverse to a longitudinal direction of the ridge member and where ventilating passages are formed in spaces between the two opposing panels and between the cross pieces, said ventilating passages allowing air to pass from the lower part of the ridge member along the ventilating passages and to the uppermost part of the ridge member.

By providing cross pieces that extend substantially transverse to a longitudinal direction of the ridge member, it is ensured that the humid air form the roof construction is passed to the ambient atmosphere as easy and unrestricted as possible. The cross pieces may extend along any distance of the ridge member, but preferably the cross pieces extend form the lower part all the distance to the uppermost part of the ridge member or at least to the top part of the ridge member.

In a second embodiment of the invention the ventilating said cross pieces extend between the lower part to the upper part of the ridge member parallel to a longitudinal direction of the ridge member, and where ventilating passages are formed as holes penetrating the cross pieces, said ventilating passages allowing air to pass from the lower part of the ridge member along the ventilating passages and to the uppermost part of the ridge member.

By providing cross pieces that extend substantially parallel with the longitudinal extension of the ridge member and by providing holes through the cross pieces it is still ensured that the humid air form the roof construction is passed to the ambient atmosphere, however not as easy and unrestricted as when the cross pieces extend vertically. The cross pieces may extend along any distance of the ridge member, but preferably the cross pieces extend along the entire longitudinal extension of the ridge member.

The ventilating device may be made of any materiel that is structurally stable enough to function as a ridge member and which can withstand the mechanical and environmentally influences that the ridge member is presented for. Preferably, the ventilating device is made of any kind of plastic. The ventilating device may also be made of any kind of metal. Finally the ventilating device may be made of a combination of different types of plastic, of different types of metal or of a combination of plastic and metal. As example, the side panels may be made of metal and the cross pieces may be made of plastic or vice versa.

If the ventilating device is made of plastic it may be made in any suitable plastic-moulding manner. If the ventilating device is made of metal it is preferably made of sheet metal but may be made in any other way like extrusion or forging. However, the thickness of the side panels and of the cross pieces may be limited if the ventilating device is made of metal, which makes it cumbersome and expensive to manufacture the ventilating device y other methods than joining of sheet metal. Different from this, when the ventilating device is made of plastic, the thickness of the material has to be larger and the possibilities of moulding plastic are more than moulding metal or wood. Still further materials to be used either for both the ridge member and the flaps or for only the flaps or only the ridge member may be sheets, plates or casts of cardboard, of wood fibres, of roofing felt or of still other materials.

If the ventilating device is constructed like the above-mentioned first embodiment it may be difficult to manufacture the ventilating device by means of extrusion. In this case the side panels are made for themselves and the cross pieces are made for themselves and the side panels and the cross pieces are subsequently mutually joined for creating the ventilating device with the passages provided between the side panels. Finally the holes through the cross pieces are made. Alternatively the holes are already made before mutually joining the side panels and the cross pieces.

If the ventilating device is constructed like the above-mentioned second embodiment it is very easy to manufacture the ventilating device by means of extrusion or by injection moulding. In this case extrusion will be the preferred way of manufacturing the ventilating device for creating the ventilating device with the passages provided between the side panels, although the ventilating device in stead may be manufactured by making the side panels for themselves and making the cross pieces for themselves and subsequently mutually joining the side panels and the cross pieces are afterwards mutually joined.

In preferred embodiments of the ventilating device, the ventilating device furthermore comprises flexible parts extending from lower edges of the ridge member downwards and being capable of bending outwards away from each other, said flexible parts are made in continuation of the opposing side panels of the ridge member and where the flexible parts have a thickness being smaller than a thickness of the opposing panels so that the flexible parts are less rigid and more flexible than the opposing side panels.

By providing the ventilating device with flexible parts a passage from the ridge member to the underlying underroof is established. This ensures that moist wind driven air cannot pass form an outer side of the side panels to the underroof when meeting the side panels of the ventilating device. Also, the side panels create an easy way of securing the ventilating device to the underroof, and alignment of the ventilating device along the ridge of the underroof is made easier by the person mounting the ventilating device along the ridge of the roof.

In a preferred embodiment of the flexile part of the ventilating device it is provided with a flap. A flap along the lower edge of the flexible part has the advantage that a proper abutment of the flexible part is obtained. If the underroof between rafter is not rigid, perhaps because the underroof is plastic foil or any other non-rigid materiel, then the flexible parts will be able to follow any deflection that the underroof will have. Providing the flexible parts with the flap makes the lower edge safer towards any moisture that may enter between the top of the underroof and the flexible parts. This is, as mentioned, especially advantageous where the flexible parts extend between rafter i.e. extend freely without being secured to any rigid part of the underroof. In a preferred embodiment a band is stretched between the rafter at least in a position where the flexible parts and preferably a position where the flaps of the flexible parts are intended for abutting the underrroof. The band is intended for supporting a bottom side of the underroof if the underroof is not rigid in order to at least limit but preferably eliminate the deflection of the underroof between the rafter.

The ventilating device according to the invention has features making the device highly flexible compared to prior art devices. All of the different features may be used in combination or separately according to demands and needs of the user. Also, the length of the device and the application of the device to different ridges can be individually selected without limiting the functional features and advantages of the device. Accordingly, the ventilating device according to the invention may be applied to top ridges or to hip ridges of a roof or other building structure. Furthermore, because of the constructional simplicity and the many possible ways of mounting of ridge copings to the ventilating device, then the ventilating device according to the invention is very well suited for roof constructions without an underroof and without insulation such as roofs in halls, in warehouses, in garages and the like where the ventilating device will be visible. The ventilating device will not disturb the visual appearance of the roof construction from the inside of the building not having an underroof and insulation.

BRIEF DESCRIPTION OF THE INVENTION

Figure 1B:
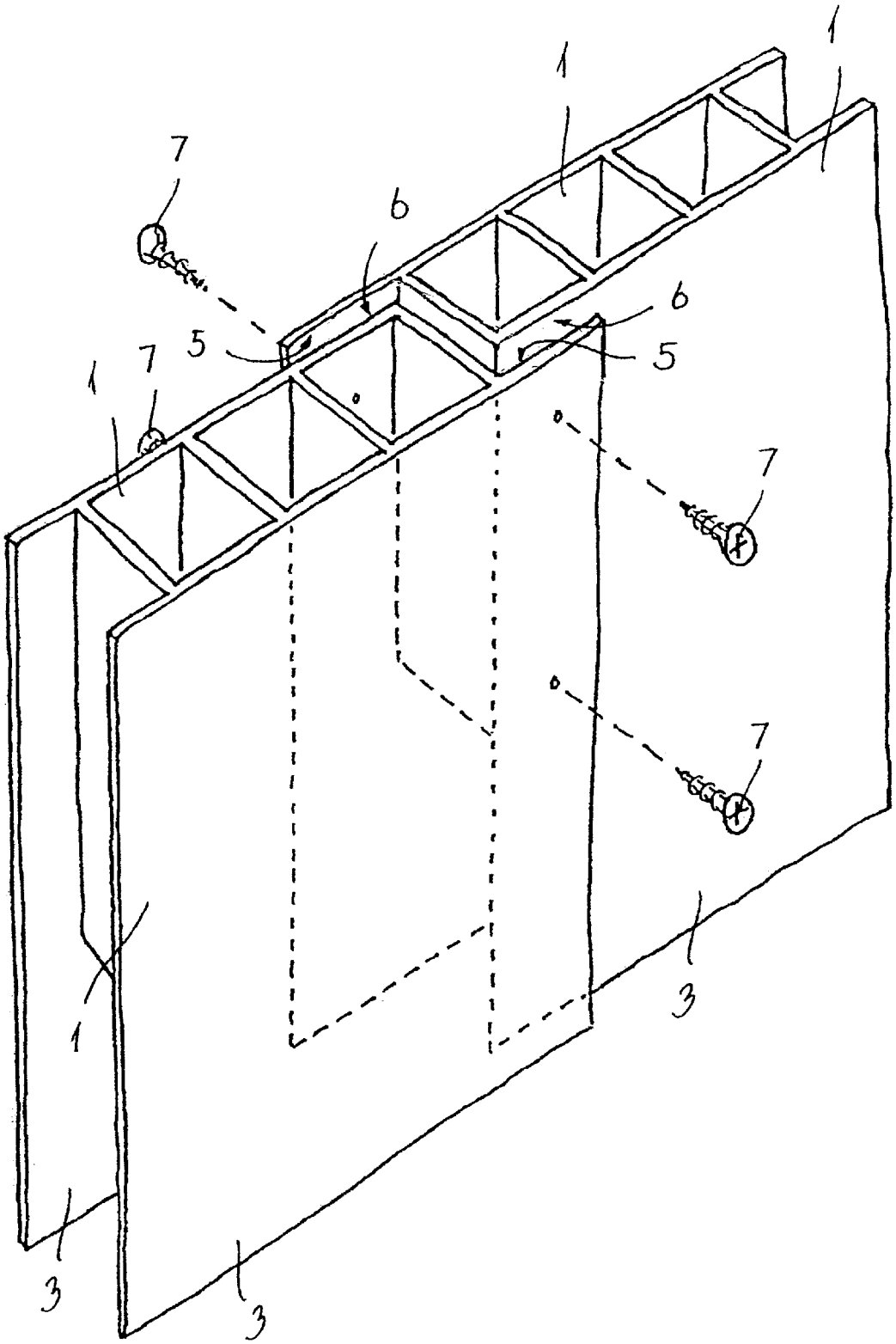
Figure 2:
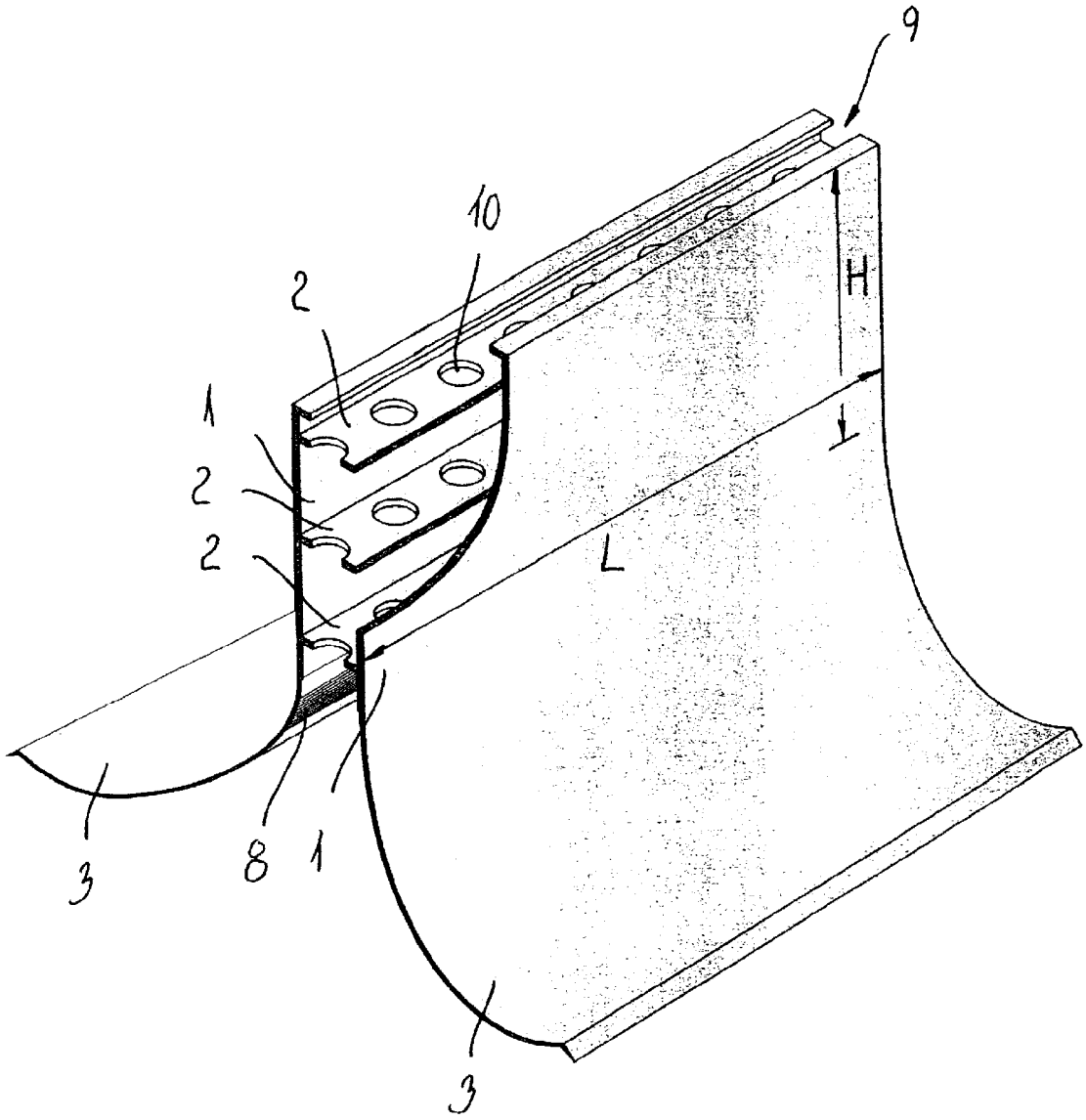
Figure 3A:
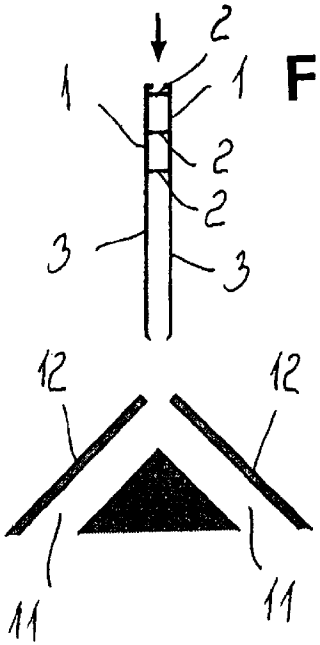
Figure 3B:
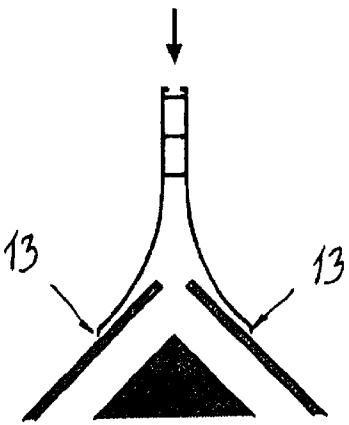
Figure 3C:
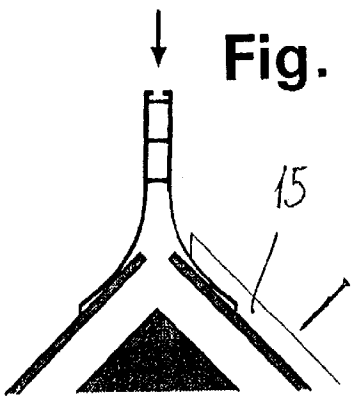
Figure 3D:
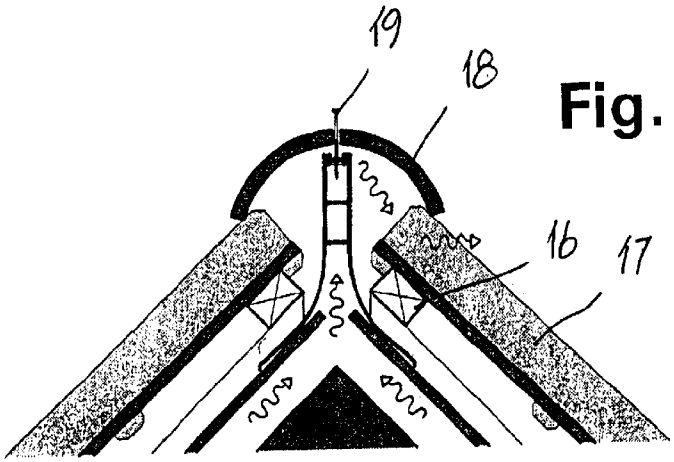
Figure 3E:
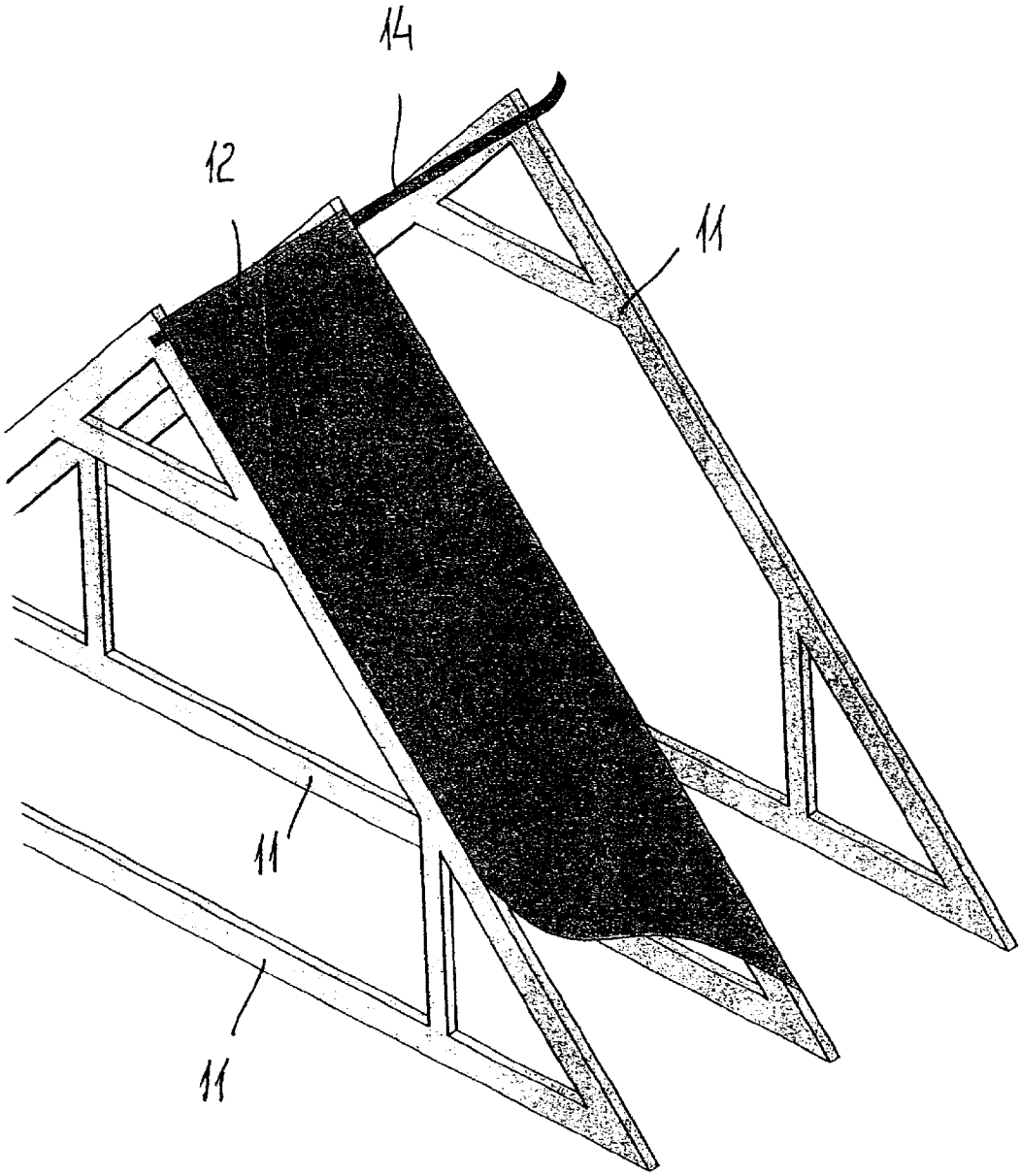
Figure 4B:
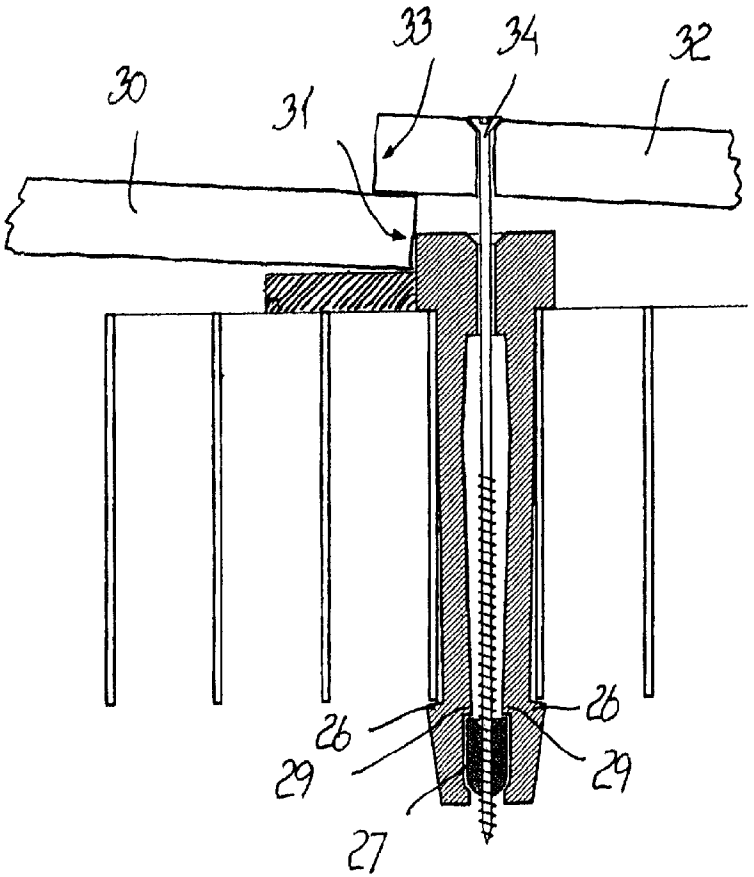
Figure 4A:
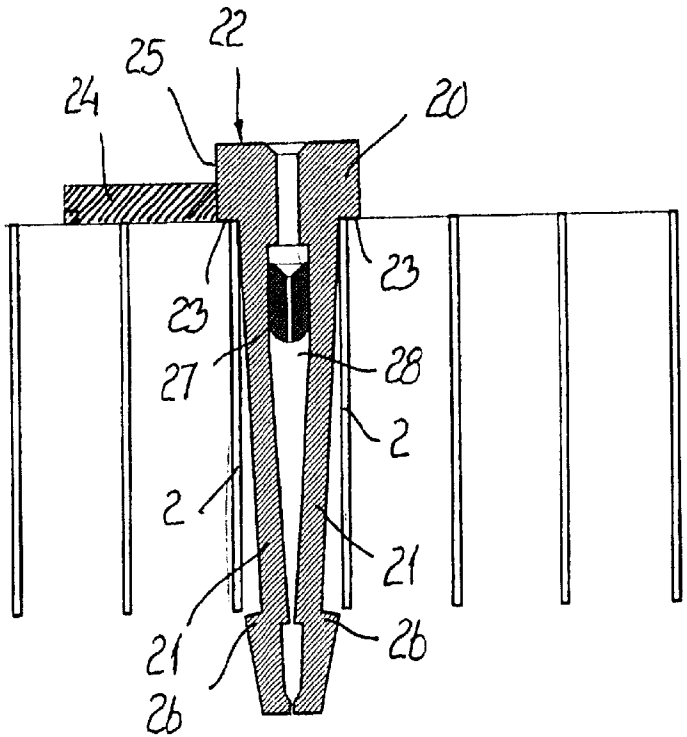
Figure 5B:
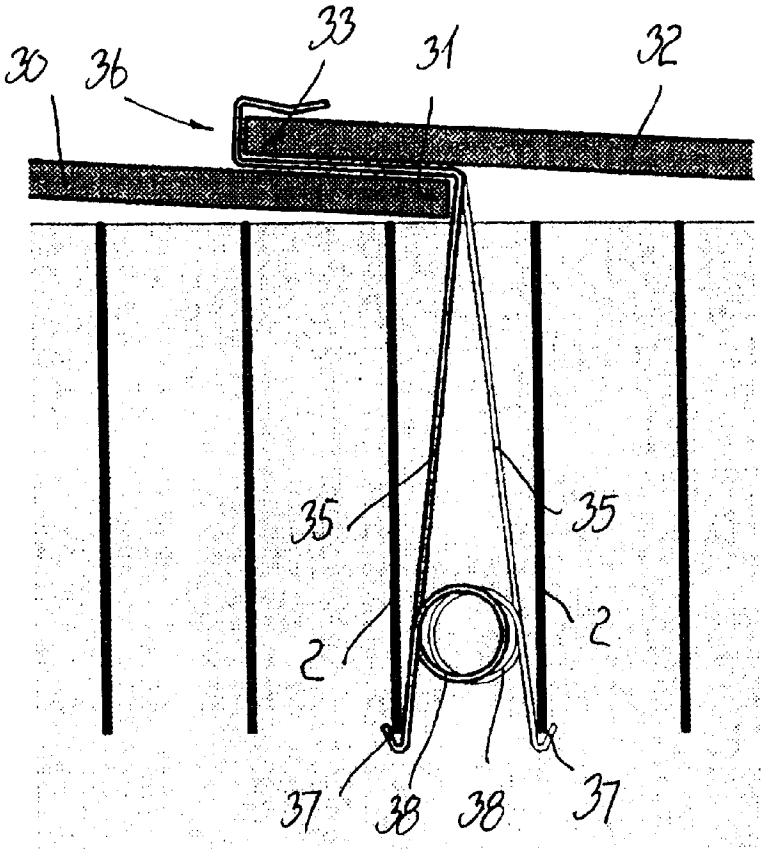
Figure 5A:
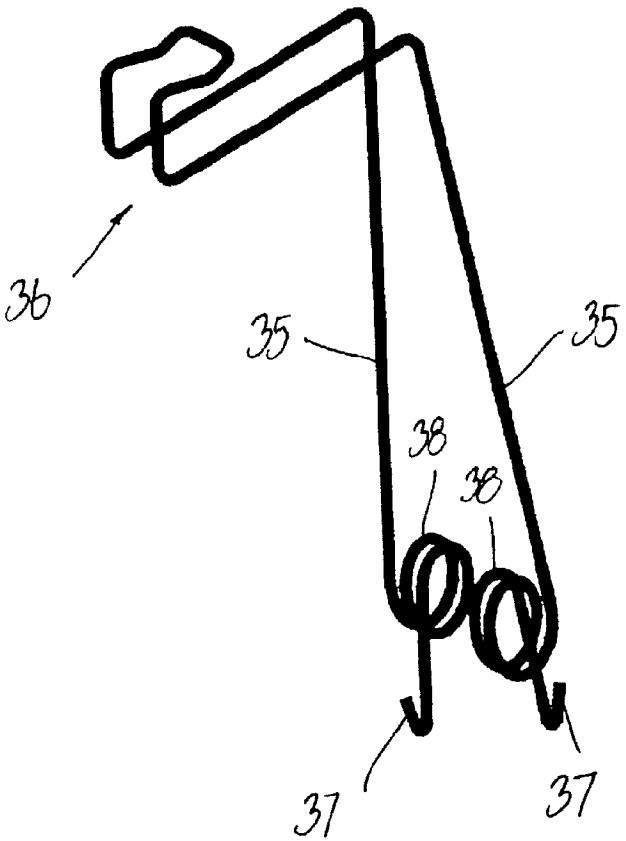
Figure 6A:
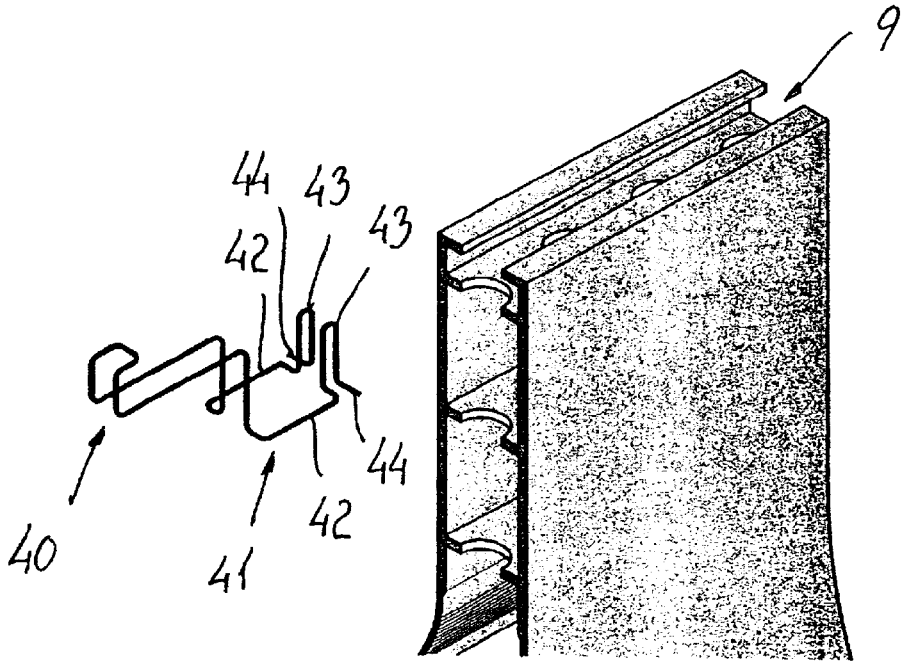
Figure 6B:
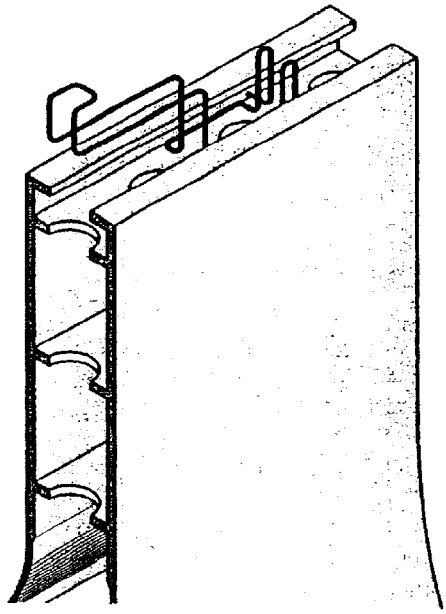
Figure 6C:
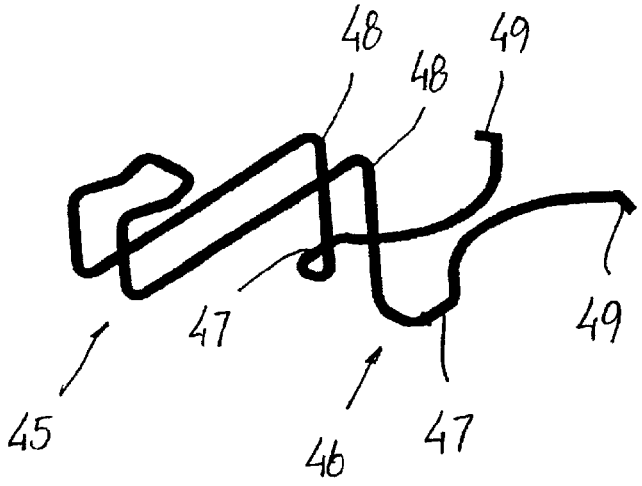
Figure 6D:
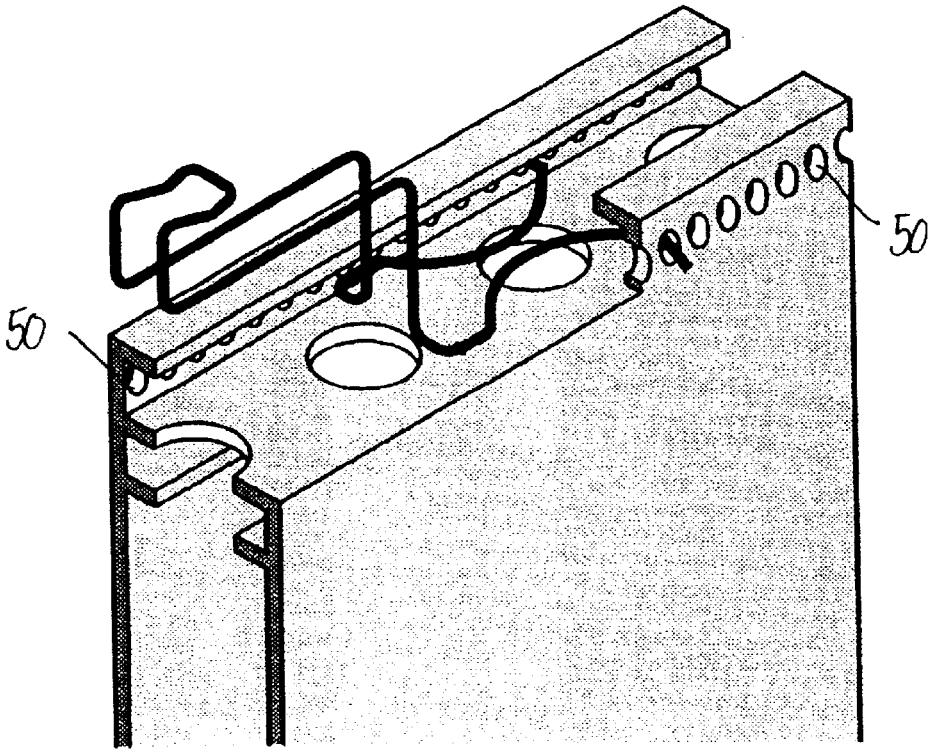
Figure 6E:
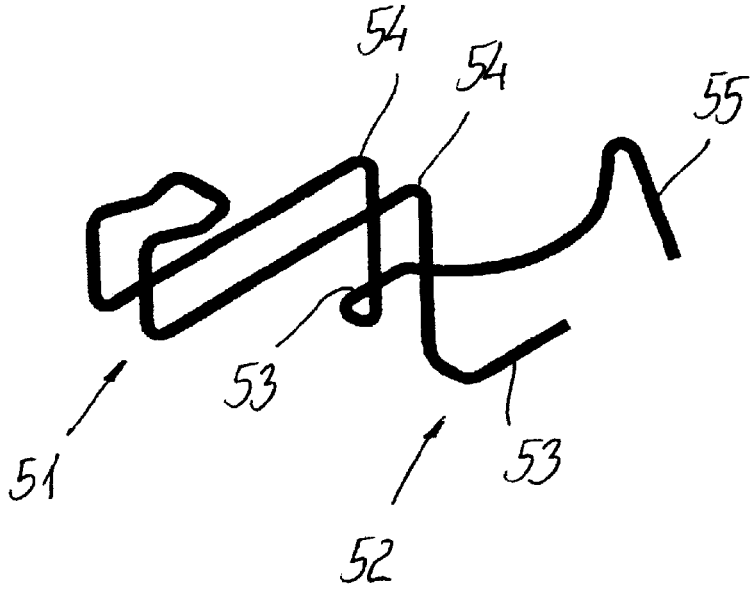
Figure 6F:
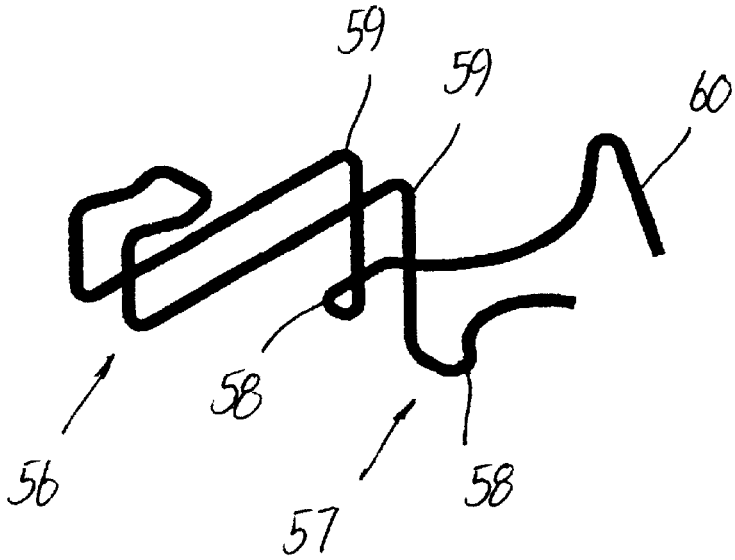
Figure 6G:
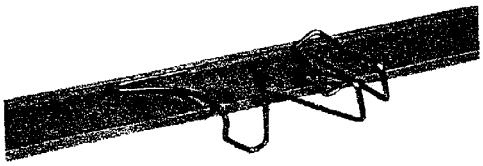
Figure 6H:
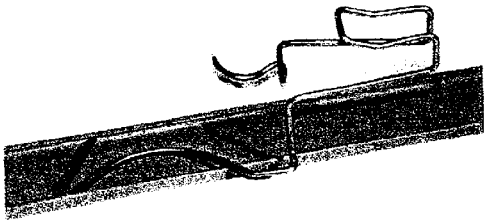
Figure 6I:
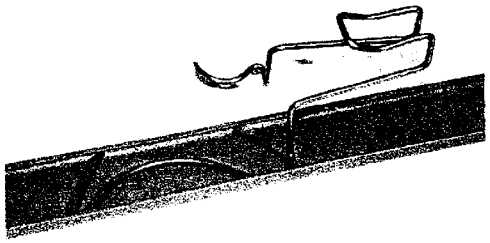
Figure 6J:
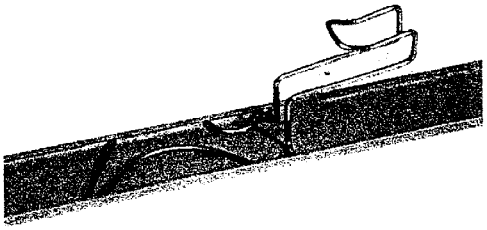
Figure 7:
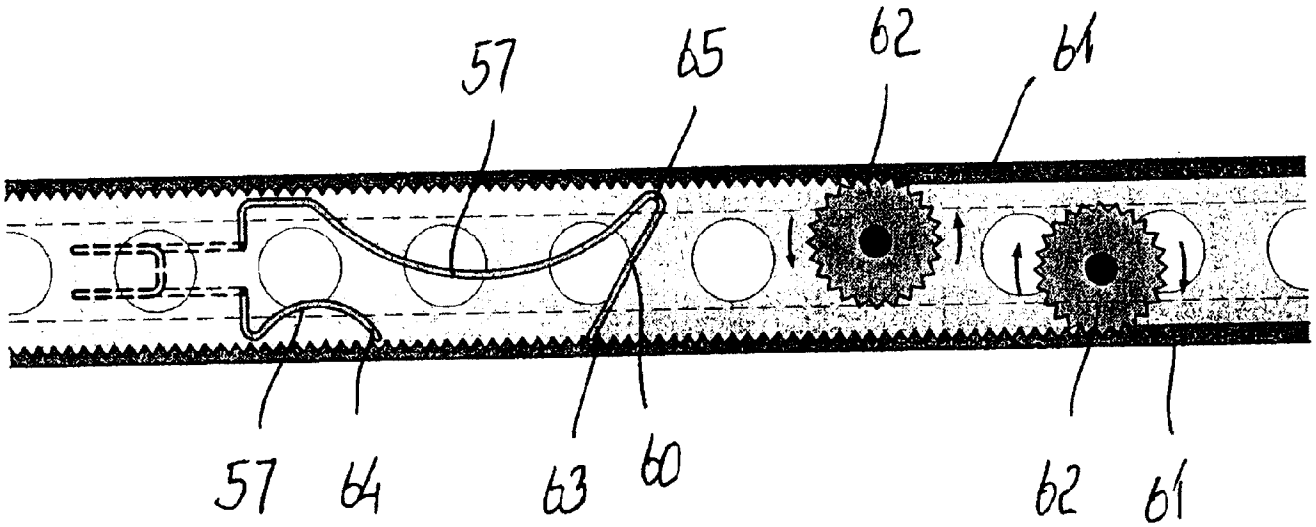
Figure 8B:
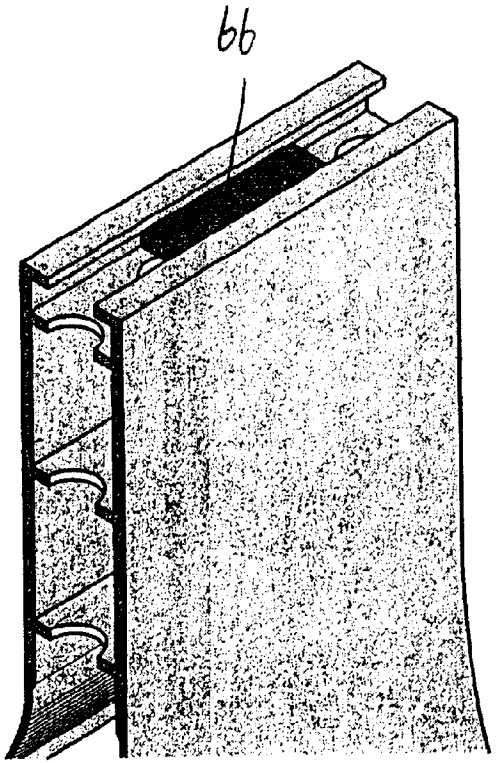
Figure 8A:
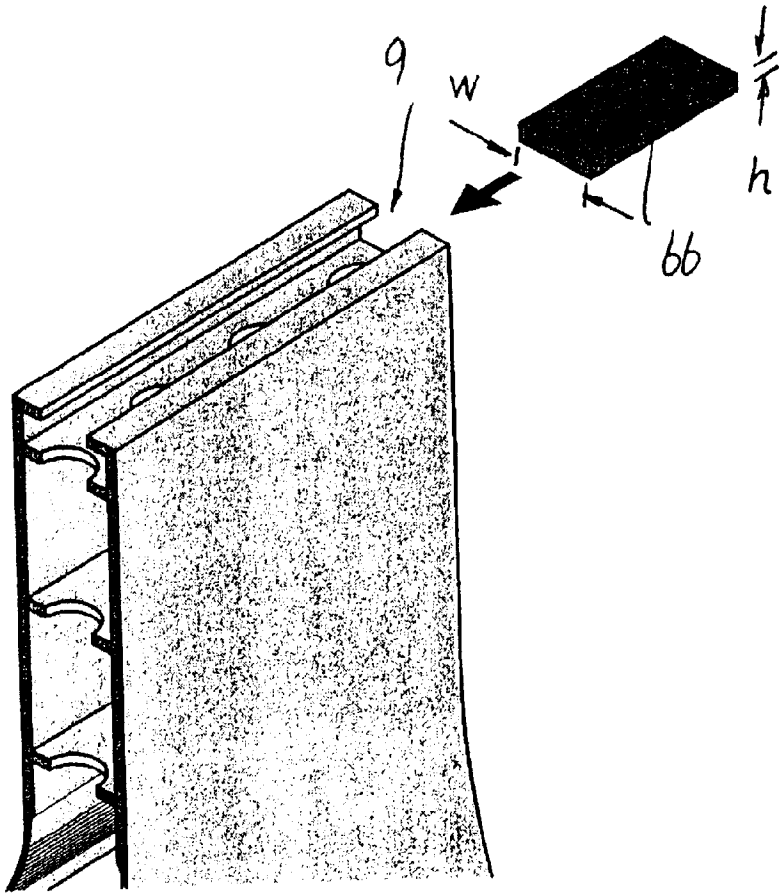
Figure 9:
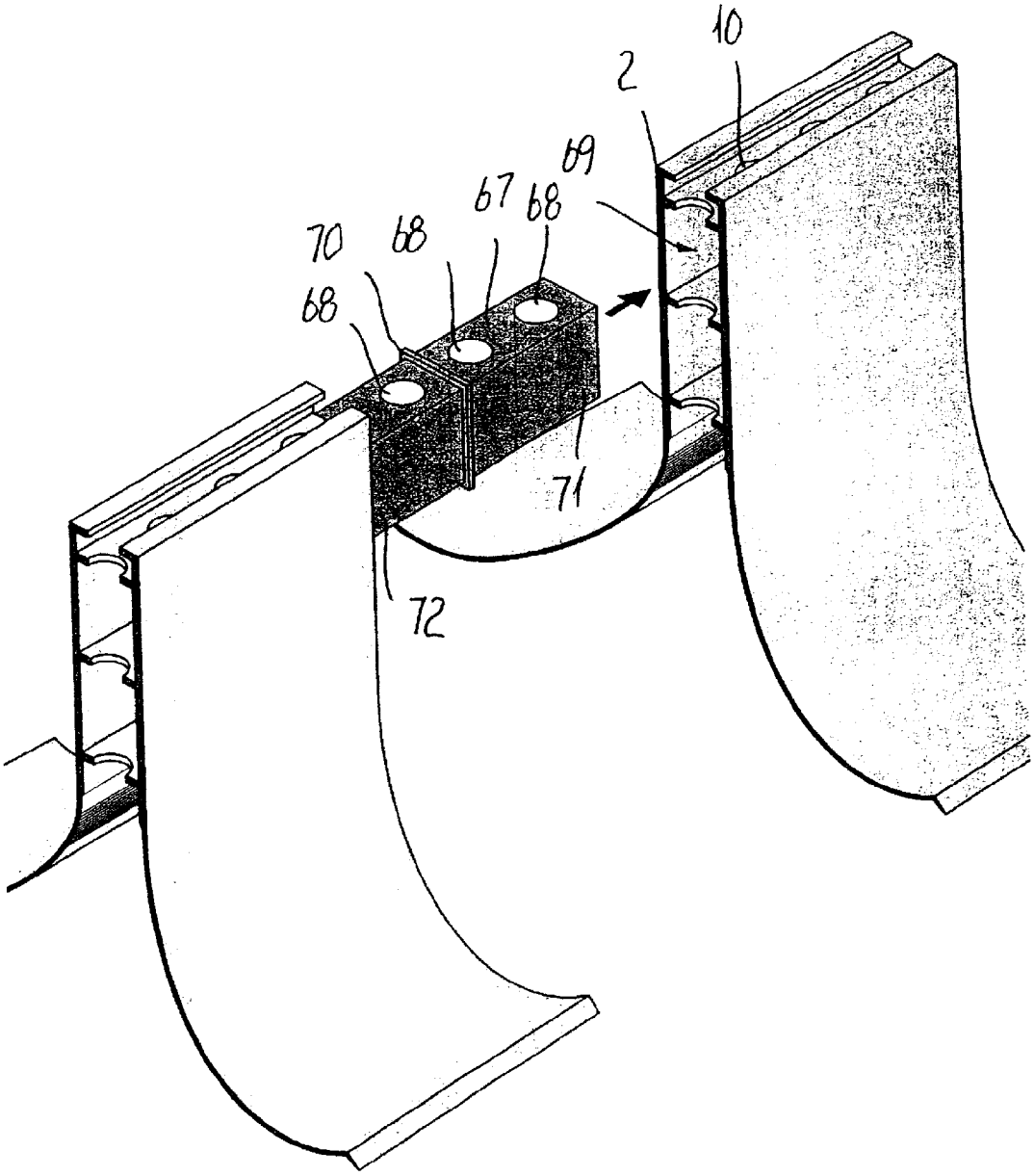
Figure 10:
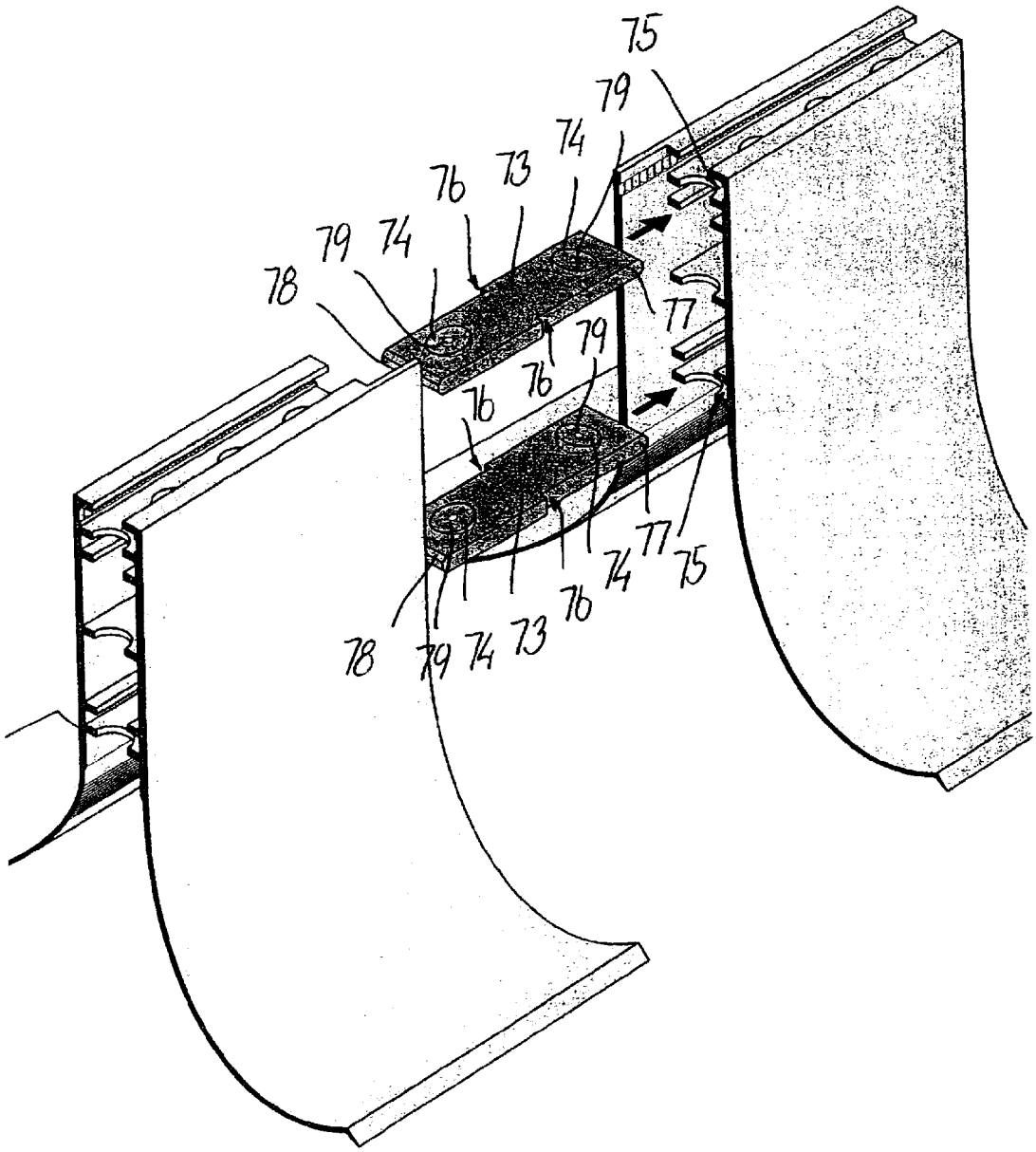

The invention will now be described in more detail with reference to the accompanying drawing where FIG. 1A and FIG. 1B are perspective views of first embodiments of a ventilating device according to the invention, FIG. 2 is a perspective view of a second embodiment of a ventilating device according to the invention, FIG. 3A to FIG. 3D are figures showing a method of mounting a ventilating device according to the invention to a roof construction, FIG. 3E is a perspective view showing a possible way of limiting or elimination any deflection of a non-rigid underroof by supporting the underroof by a band, FIG. 4 is a cross section of an embodiment for a mounting plug for mounting a ridge coping to the first embodiment of the ventilating device, FIG. 5A and FIG. 5B are a perspective view and a cross section of an embodiment for a mounting clip for mounting a ridge coping to the first embodiment of the ventilating device, FIG. 6A and FIG. 6B are perspective views of a first embodiment of a mounting clip for mounting a ridge coping to the second embodiment of the ventilating device, FIG. 6C and FIG. 6D are perspective views of a second embodiment of a mounting clip for mounting a ridge coping to the second embodiment of the ventilating device, FIG. 6E and FIG. 6F are perspective views of a still other embodiment of a mounting clip for mounting a ridge coping to the second embodiment of the ventilating device, FIG. 6G to FIG. 6J are pictures showing placing of a mounting clip as shown in FIG. 6F to a groove similar to one that may be provided on the top of the ventilating device, FIG. 7 is a plane view of a possible way of manufacturing a serrated grove in a second embodiment of a ventilating device, FIG. 8A and FIG. 8B are perspective views of a mounting piece for mounting a ridge coping to the second embodiment of the ventilating device, FIG. 9 is a perspective view of a first embodiment of a connecting piece for mutual joining of two second embodiment ventilating devices, and FIG. 10 is a perspective view of a first embodiment of a connecting piece for mutual joining of two second embodiment ventilating devices.

DETAILED DESCRIPTION OF THE INVENTION

FIG. 1A shows a first embodiment of a ridge member constituting part of a ventilating device according to the invention. The member comprises two opposed side panels 1 and cross pieces 2 intermediate the side panels 1. The side panels 1 and the cross pieces 2 together form a rigid part intended for constituting a ridge beam member of the roof construction. Flexible parts 3 extend downward from the side panels 1 and are capable of bending outwards. The flexible parts 3 are intended for abutting an underroof (see FIGS. 3A–3D). The side panels 1 each have a length L and a height H and in one end the side panels 1 have extensions 4 extending past a final cross piece. The extensions 4 are intended for providing an overlap between neighbouring ridge members extending longitudinally in relation to each other such as shown in FIG. 1B. The overlap is provided by an inner surface 5 of the extensions abutting an outer surface 6 of one of the side panels 1 of the neighbouring ridge member. If preferred, the overlap may be secured by joining the extensions 4 to the side panels 1, which the elongated part abuts. Joining may take place by screws 7 or other suitable means. The cross pieces 2 are provided with a mutual spacing S. The spacing S between the cross pieces 2 form passages for humid air from a lower part of the ridge member directed towards the roof construction to a top of the ridge member directed towards the ambient atmosphere (see FIGS. 3A–3E).

FIG. 2 shows a second embodiment of a ridge member. The device also comprises two opposed side panels 1 and cross pieces 2 intermediate the side panels. As previously mentioned, the side panels 1 and the cross pieces 2 together form a rigid part intended for constituting a ridge beam member of the roof construction. Flexible parts 3 extend downward from the side panels and are capable of bending outwards. As mentioned, the flexible parts 3 are intended for abutting an underroof (see FIGS. 3A–3D). The flexible parts 3 may be provided with ribs 8 for making a lower side, alternatively on an upper side, ribbed in order to enhance the flexibility of the flexible parts 3. The side panels 1 each have a length L and a height H and on the top, the side panels are provided with undercut sections. Together with an upper cross piece 2 the undercut sections establish a dove-tail groove 9.

The dove-tail groove 9 is intended for taking up a sliding member such as a clip as shown in FIGS. 6A and 6B or such a small sliding plate as shown in FIGS. 7A and 7B. The sliding member is intended for mounting of a ridge coping (not shown) to the ridge member. In 35 the embodiment shown, the ridge member is provided with a number of cross pieces, in the embodiment shown three cross pieces 2, extending longitudinally along the ridge member. The cross pieces 2 are provided with holes 10. The holes form passages for humid air from a lower part of the ridge member directed towards the roof construction to a top of the ridge member directed towards the ambient atmosphere (see FIGS. 3A–3E).

The distance that the cross pieces provide between the side panels is between 10 mm and 100 mm, preferably between 20 mm and 50 mm. The cross pieces are provided along a longitudinal extension of the ridge member with any mutual distance that is sufficient to establish and maintain the distance between the side panels. Thus the number of cross pieces depend on the distance between the side panels, of the material that the side panels are made of and of the thickness of the side panels. Preferably the number of cross pieces is selected so that a mutual distance between the cross pieces is between mm 10 and 500 mm, preferably between 10 mm and 50 mm.

The ridge members shown in FIGS. 1A, 1B and FIG. 2 are preferably made of plastic. However the ridge member may be made of any suitable material such as sheets of corrosion resistant metal like stainless steel or aluminium. The ridge member may also be made of a combination of different materials. Thus, the ridge member may be made of one material and the flexible parts of another material and the parts mutually joined in any suitable manner. Thereby, the ridge member may be made of materials not in itself flexible such as thick sheets of plastic or metal or such as plywood and the flexible parts of course made of a flexible material such as thin plastic or sheets of metal.

The ridge member shown in FIG. 1A is preferably made of sheets of plastic, metal or other materials. The ridge member may be manufactured by extrusion if the longitudinal extension of the ridge member is limited such as length up to 1 m or less. Another way of manufacturing the ridge member in any length includes manufacturing the side panels together with the flexible parts separately and manufacturing the cross pieces separately. Afterwards, the side panels and lateral edges of the cross pieces are mutually joined in any suitable manner like gluing, welding or by specially provided mechanical joints. The ridge member shown in FIG. 2, if made in plastic, is preferably made by extrusion. This provides a very cheap and easy way of manufacturing the ridge member. The holes in the cross pieces are made after the extrusion by drilling through the cross pieces or by using any other suitable kinds of machining of the cross pieces such as milling, punching, water, laser- or flame cutting etc. In the embodiment shown the holes are circular, but the holes may have any other shape such as oval or square.

In the embodiments shown only the second embodiment is provided with a dove-tail groove. However, in an alternative embodiment, the first embodiment may also be provided with a similar groove. Furthermore, in an alternative embodiment of the second embodiment the second embodiment need not be provided with the groove.

FIGS. 3A to 3E show a method for mounting of a ventilating device to a roof construction during building of the roof construction. As example of a ridge member being mounted the second embodiment shown in FIG. 2 is used. The roof construction comprises rafter 11 and onto the rafter an underroof 12 is secured. The ridge member is mounted from the top and downwards onto the rafter and the underroof. The flexible parts are bent outwards and when the ridge member are pressed downwards towards the underroof to the correct height of the top of the ridge member, the flexible parts abut the underroof. In the embodiment shown the roof construction has roof surfaces with the same slope on each side of the ridge. However, the slope on each side of the ridge may be different, and in this case the flexible parts on each side of the ridge will bent outwards differently to each other, depending on the slope of the roof surface that the flexible part in question abut.

A flap 13 provided at the lower edge of the flexible parts ensures a proper and safe abutment between the flexible parts and the underroof. The ridge member is secured to the underroof by screws or other fastening means securing the flexible parts to the rafter. In case the underroof is not rigid such as an underroof consisting of plastic foil there is a risk that a deflection of the underroof between rafter is to great for the flexibility of the flexible parts to still abut the underroof along the entire extension of the underroof, also along the extension between the rafter.

FIG. 3E shows a possible means for remedying this inconvenience. A band 14 is stretched between the rafter in a position where the flexible parts abut the underroof, and preferably in a position where the flaps of the flexible parts is intended for abutting the underroof. The band 14 is preferably a fibre reinforced plastic ribbon but the band may be made from other materials. The band is attached to the rafter and the underroof is either just supported by or is even secured to the band and to the rafter by means of staples or the like, the band thus at least supporting a bottom side of the underroof. This at least limits, but preferably eliminates, the deflection of the underroof between the rafter, thereby ensuring proper and safe abutment between the flexible parts and the underroof in order to prevent moist from being led into the roof construction between the flexible parts and the underroof.

After the ridge member has been mounted the rest of the roof construction is made. Spacing lists 15 are secured to the flexible parts by means of screws or other fastening means. Thereafter lathes 16 are secured to the spacing lists 14 and the roof cladding 17 such as roof tiles are mounted onto the lathes. Finally, a ridge coping 18 such as ridge tiles are mounted to the top of the ridge member by one of the mounting means shown in the following figures and perhaps screws 19 or other fastening means depending on the mounting means. When the ridge member and the other items constituting the ventilating device and the roof construction have been mounted, humid air from underneath the underroof may be ventilated out to the ambient atmosphere as shown with wave-shaped arrows.

As shown, the humid air is passed from underneath the underroof to the lower part of the ridge member, through the passages in the cross pieces and to the top of the ridge member right underneath the ridge coping, and therefrom to an outer and lower edge of the ridge coping to the ambient atmosphere out through openings between the ridge coping and the roof cladding. The top of the ventilating device is provided in the middle of the ridge of the roof and is provided rather high up towards the ridge coping. These features ensure that the passages for the humid air through the ventilating device end very high up in the ridge coping. Thereby the risk is very limited of wind driven moisture such as dew or snow entering the underroof through the passages in the ridge member.

FIGS. 4A and 4B shows a mounting means for mounting of roof tiles or other ridge coping to a first embodiment of a ridge member according to the invention. The mounting means consist of a mounting plug 20, preferably made of plastic, having legs 21 functioning the same way as a plastic rawplug® in a wall and extending down through a passage in the ridge member, and a head 22 with shoulders 23 resting on upper edges of the cross pieces 2. Sideways from the head a tongue 24 extends. The tongue 24 is intended as a support for a rear end of a roof tile. The support can be effected along the entire extension of the tongue. Between the tongue 24 and the head 22 a shoulder 25 is established. This shoulder is intended as a possible rest for a rear edge of a roof tile as shown in FIG. 4B.

However, the shoulder 25 will only function as a rest for the rear end of the roof tile if the division of the passages into which the plugs fit along the ventilating device is an even number multiplied with the length of a roof tile. Otherwise, only some of the shoulders of the plugs will function as actual rests and intermediate plugs will only function as supports the rear end of the roof tile on the tongue 24. The legs 21 of the mounting plug are provided with exterior projections 26 extending outwardly and intended for engaging with lower edges of the cross pieces 2. The engagement is established by means of an interior plug 27, that is provided in a central bore 28 within the legs of the mounting plug.

When an initial roof tile 30 has been placed with the rear edge 31 resting against the shoulder 25, and a subsequent roof tile 32 has been placed with a front end 33 on the head 22 of the plug 20, as shown, a screw 34 is passed through the subsequent roof tile 32 and into the interior plug 27. The screw 34 and the interior plug 27 are then pushed downwards through the central bore 28 so that the interior plug 27 passes interior shoulders 29 provided at the bottom of the plug 20 en extending inwardly from the legs 21. Further screwing results in the screw being screwed further into the interior plug for securing of the subsequent roof tile 32 to the ridge member. Because of the interior plug 27 having passed the interior shoulders 29, the interior plug cannot pass the shoulders 29 and be pulled upwards. Consequently, the legs 21 of the plug 20 cannot pass the lower edge of the cross pieces 2, and therefore the plug cannot be pulled out of the spaces established between the cross pieces. In an alternative embodiment, the interior plug 27 may be excluded and securing of the plug in the space between the cross pieces is thus established by the screw itself biasing the exterior projections 26 outwards and preventing the plug from being pulled out of the space between the cross pieces. Because the rear edge 31 of the initial roof tile 30 is placed underneath the front edge 33 of the subsequent roof tile 32 and because the subsequent roof tile 32 is secured to the mounting plug 20, both of the roof tiles 30,32 cannot be pulled away from the ridge member by as example gusts of wind.

FIGS. 5A and 5B show an alternative embodiment of a mounting means for mounting of roof tiles or other ridge coping to a first embodiment of a ridge member according to the invention. The mounting means consist of a mounting brace having two legs 35 extending down through a passage in the ridge member and a loop 36 being directed sideways. As shown, the loop 36 is intended for resting on a rear edge 31 of an initial roof tile 30 and is in itself intended for securing the front end 33 of an overlapping subsequent roof tile 32 to the mounting brace. The legs 35 of the mounting loop are provided with barbs 37 extending outwardly and intended for engaging with lower edges of the cross pieces 2. The engagement is established by a resilience that the mounting loop posses. In the embodiment shown the resilience is established by means of spiral springs 38 provided as part of the legs 35 of the mounting brace. Alternative means for providing resilience may be provided.

The mounting brace is being mounted over the rear end 31 of the initial roof tile 30 already being in place on top of the ridge member. The legs 35 of the mounting brace extend down through the passages of the ridge member and the barbs 38 are placed in engagement with the lower edges of the cross pieces. Thereby a consisting engagement between the barbs and the lower edge of the cross pieces 2 is established. Afterwards, the front end 33 of the subsequent roof tile 32 is slid into the loop 36. Because of the engagement between the barbs 37 of the mounting brace and the lower edges of the cross pieces 2, the mounting brace cannot be pulled away from the ridge member. Accordingly, as the rear end 31 of the initial roof tile 30 is secured under the loop 36 and the front end 33 of the subsequent roof tile 32 is secured in the loop 36, both of the roof tiles 30,32 cannot be pulled away from the ridge member by as example gusts of wind.

In the embodiments of mounting means as shown in FIG. 4 and FIG. 5 the mounting plug and the mounting brace are used in the first embodiment of the ridge member with the legs of the plug or of the brace extending through the spacing established between the cross pieces. Alternatively, the mounting plug and the mounting brace can be used in the second embodiment of the ridge member with the legs of the plug or of the brace extending through the holes provided in the cross pieces of the second embodiment. If the mounting plug or the mounting brace is used in connection with the second embodiment, then the second embodiment need not be provided with the dove-tail groove shown in FIG. 2.

FIGS. 6A and 6B shows a further embodiment of a mounting means to be used in cooperation with the dove-tail groove shown in FIG. 2. The mounting means consist of a mounting clip having a loop 40 corresponding to the loop 36 of the mounting brace shown in FIG. 5. The mounting clip also has legs 41, but being differently shaped. The legs 41 comprise a guiding section 42 intended for guiding the mounting loop in the groove. The legs 41 also comprise handling sections 43 intended to be used as finger grips for manually pulling the legs together. The mounting clip is resilient so that the legs 41 will tend to bias away from each other, when the legs are not manually pulled together. Finally, the legs have locking ends 44 intended for engaging with the interior of the dovetail groove 9 and thereby locking the mounting clip to the groove.

Mounting of roof tiles to the ridge member by means of the mounting clip takes place in the same manner as when mounting the roof tiles by means of the mounting brace shown in FIGS. 5A and 5B. Positioning of the mounting clip takes place by pulling the legs 41 together by use of the handling sections 43, subsequently installing the mounting clip into the groove 9 at the proper position in the groove, and finally releasing the handling sections 43 so that the locking ends 44 partly or fully penetrate the lateral sides of the groove, thereby securing the mounting clip in the position chosen. Subsequently, the mounting clip may be used to secure rear ends and front ends of roof tiles to the ridge member in the same manner as the mounting brace in FIGS. 5A and 5B.

FIGS. 6C and 6D show an alternative embodiment of a mounting clips to be used in connection with a groove such as shown in FIG. 6A and FIG. 6B. The mounting clip shown in also comprises a loop 45 and legs 46 with guiding sections 47. Handling sections 48 are established between the loop 45 and the guiding sections 47. Positioning of the mounting clip takes place by pulling the legs 46 together, subsequently installing the mounting clip into the groove 9 at the proper position in the groove, and finally releasing the handling sections 48 so that the pointed ends 49 of the legs 41 engage with holes 50 in the lateral sides of the groove 9, thereby securing the mounting clip in the position chosen. Subsequently, the mounting clip may be used to secure rear ends and front ends of roof tiles to the ridge member in the same manner as the mounting brace in FIGS. 5A and 5B.

FIG. 6E shows a still alternative embodiment of a mounting clips to be used in connection with a groove such as shown in FIG. 6A and FIG. 6B. The mounting clip shown also comprises a loop 51 and legs 52 with guiding sections 53. Handling sections 54 are established between the loop 51 and the guiding sections 53. Positioning of the mounting clip takes place by pulling the legs 51 together, subsequently positioning the mounting clip into the groove to the proper position in the groove, and finally releasing the handling sections 54 so that the legs 51 of the guiding section 53 abut the lateral sides of the groove, thereby securing the mounting clip in the position chosen. A transverse legging 55 also abuts the lateral sides of the groove and establish a toggle joint. Subsequently, the mounting clip may be used to secure rear ends and front ends of roof tiles to the ridge member in the same manner as the mounting brace in FIGS. 5A and 5B.

FIG. 6F shows a still further alternative embodiment of a mounting clips to be used in connection with a groove such as shown in FIG. 6A and FIG. 6B. The mounting clip shown also comprises a loop 56 and legs 57 with guiding sections 58. Handling sections 59 are established between the loop 56 and the guiding sections 58. Positioning of the mounting clip is shown in FIGS. 6G–6J and takes place by firstly positioning a pointed end of a transverse legging 60 in engagement with one lateral side of the groove, secondly positioning a supporting part of the leg along the other lateral side of the groove, and finally pulling the legs together and positioning a pointed end and a supporting part of the other leg along the one lateral side of the groove. Thereby, the clip is supported in and secured to the groove in the position chosen. The transverse legging 60 establish a toggle like bend 65. Subsequently, the mounting clip may be used to secure rear ends and front ends of roof tiles to the ridge member in the same manner as the mounting brace in FIGS. 5A and 5B.

FIG. 7 shows a possible embodiment of manufacturing serrated lateral sides 61 of the groove 9. Providing serrated lateral sides 61 of the groove is an advantage when securing the mounting clips shown in the previous figures to the groove. Manufacture takes place by letting a couple of serrated sprockets 62 run along the lateral sides 61 of the groove 9. The serration may take place during manufacture of the ridge member itself or may take place afterwards as a finishing of the ridge member, perhaps together with the drilling of the holes in the cross pieces. As shown, a mounting clip with a transverse legging 60 will have one pointed end 63 of the transverse legging 60 engaging the serration along one serrated lateral side of the groove, and another pointed end 64 of a leg 57 also engaging the serrated lateral side of the groove, thus avoiding the need or risk of the pointed ends fully or partly penetrating the lateral sides.

The pointed end 63 prevents the clip from being displaced to the left as seen in the figure and the pointed end 64 prevents the clip from being displaced to the right as seen in the figure. The prevention of the displacement is very well obtained when the lateral sides of the groove are serrated as shown in the figure. A toggle joint like bend 65 between an opposite leg 57 and the transverse legging 60 engaging, not the serrations themselves, but just the lateral side 61 in general. If the mounting clip is pulled in a left hand direction the transverse legging will have its pointed end 63 engaging the serrated lateral side and the toggle like bend engaging the lateral side, thus providing a toggle joint securing the mounting clip to the groove. This ensures a high degree of securing of roof tiles to the ridge, which especially is an advantage when the roof tiles are mounted along hips of the roof compared to the top ridge of the roof, because along the hips of a roof the clip is not not only subjected to external influences such as wind loads, but is also partly subjected to the weight of the roof tile itself.

FIGS. 8A and 8B shows an even further embodiment of a mounting means to be used in cooperation with the dove-tail groove shown in FIG. 2. The mounting means consist of a mounting plate 66 having a width w that is substantially the same as a width of the groove 9 and having a height h substantially the same as or smaller than a height of the groove 9. The mounting plate 66 is intended for taking up the threaded end of a screw, that is screwed through a ridge coping in order to secure the ridge coping to the ventilating device. Positioning of the mounting plate takes place by sliding the mounting plate along the groove to the proper position along the groove. Subsequently, the mounting plates may be used as attachment means for the threaded section of a screw mounted through a roof tile. Alternatively, the mounting clip may be used in connection with known mounting clips as they are used today, where the known mounting clips are secured to a ridge beam of wood. Instead, known mounting clips may be secured to the mounting plate if known mounting clips are used in connection with the ventilating device according to the invention.

FIG. 9 shows a first embodiment of a connecting piece 67 for connecting neighbouring ridge members of the second embodiment along a ridge. The connecting piece 67 consists of an elongated member with a square cross section and being provided with holes 68 extending perpendicular to the longitudinal direction of the connecting piece. The cross section of the connecting piece has dimensions corresponding to dimensions of a number of longitudinal canals 69 formed in the ridge members between the cross pieces 2. At the middle of the connecting piece a collar 70 is provided so that two oppositely directed ends 71,72 are formed. The connecting piece is preferably made of plastic, but other materials such as metal or wood may be used.

Each of the ends 71,72 of the connecting piece is intended for being taken up in a canal of the neighbouring ridge members. The collar 70 at the middle of the connecting piece 67 ensures that the connecting piece unintentionally cannot be displaced into a canal 69 of only one ridge member resulting in that no connection is established. The holes 68 in the connection pieces are placed so that they lie in extension of the holes 10 in the cross pieces 2 of the ridge member. Thereby the passages are maintained for letting the humid air from the roof construction to the ambient atmosphere.

FIG. 10 shows a second embodiment of a connecting piece 73 for connecting neighbouring ridge members of the second embodiment along a ridge. The connecting piece 73 consists of an elongated member being provided with wedge-like bodies 74 extending outwardly from the elongated member. The wedge-like bodies 74 are intended for engaging with the holes 10 in the cross pieces 2 of the ridge member. A cross section of the connecting piece has dimensions corresponding to dimensions of a number of specific longitudinal canals 75 formed in the ridge members between the cross pieces 2 and being specifically intended for taking up the connecting pieces 73. At the middle of the connecting piece incisions 76 are provided so that two oppositely directed ends 77,78 are formed. The connecting piece is preferably made of plastic, but other materials such as metal or wood may be used.

Each of the ends 77,78 is intended for being taken up in a specific canal 75 of the neighbouring ridge members. In the embodiment shown the ridge members have side panels 1 with extensions 4 for providing an overlap between neighbouring ridge members such as the one shown in FIGS. 1A and 1B. The incisions 76 at the middle of the connecting piece 73 ensure that the connecting piece unintentionally cannot be displaced into a specific canal 75 of only one ridge member resulting in that no connection is established. Holes 79 in the wedge-like bodies 74 are intended for establishing guidance for a drill if and when the ridge members are to be disconnected in which case the wedge-like members must be removed by destroying them. Passages are not provided where the wedge-like bodies 74 engage with the holes 10 in the cross pieces 2, but passages are maintained between the connecting pieces for letting the humid air from the roof construction to the ambient atmosphere.

In the above reference is made to a ridge of a roof. However, ridge does not necessarily mean the top ridge but may also be ridges along a hip of the roof. Also, the ridge need not be ridge of a roof but can be ridges of walls or other building structures.

What is claimed is:

1. A ventilating device for ventilating through a ridge, preferably through a top ridge of a roof, wherein said ventilating device comprises a ridge member intended for extending longitudinally along and beneath the ridge, said ridge member having a rigid part comprising two opposed panels and a number of cross pieces extending between the opposing panels, and said ridge member having passages extending from a lower part of the ridge member to an upper part of the ridge member, said upper part being an uppermost part of the ridge member.

2. A ventilating device according to claim 1, wherein said cross pieces extend from the lower part to the upper part of the ridge member transverse to a longitudinal direction of the ridge member and where ventilating passages are formed in spaces between the two opposing panels and between the cross pieces, said ventilating passages allowing air to pass from the lower part of the ridge member along the ventilating passages and to the uppermost part of the ridge member.

3. A ventilating device according to claim 1, wherein said cross pieces extend between the lower part to the upper part of the ridge member parallel to a longitudinal direction of the ridge member, and where ventilating passages are formed as holes penetrating the cross pieces, said ventilating passages allowing air to pass from the lower part of the ridge member along the ventilating passages and to the uppermost part of the ridge member.

4. A ventilating device according to claim 1, wherein the cross pieces are attached to inner surfaces of the two opposing side panels and where the cross pieces establish a mutual distance between the opposing side panels.

5. A ventilating device according to claim 4, wherein the ridge member is made of plastic sheets, and wherein the two opposing panels and the cross pieces after manufacture are mutually joined by a process selected from the group consisting of welding and gluing.

6. A ventilating device according to claim 4, wherein the ridge member is made of plastic, and is made by a method selected from the group consisting of extrusion and injection molding, and wherein the two opposing panels and the cross pieces after manufacture form a corporate unit.

7. A ventilating device according to claim 4 wherein the ridge member is made of metal and wherein the two opposing panels and the cross pieces after manufacture are mutually joined by a process selected from the group consisting of welding, gluing, and soldering.

8. A ventilating device according to claim 1, wherein the ventilating device furthermore comprises flexible parts extending from lower edges of the ridge member downwards and being capable of bending outwards away from each other, said flexible parts being made in continuation of the opposing side panels of the ridge member and where the flexible parts have a flexibility along the outwards extension of the flexible parts enabling the flexible parts at least to flex along an underroof having a different slope at each side of the ridge member.

9. A ventilating device according to claim 8, wherein the ventilating device further comprises flexible parts extending from lower edges of the ridge member downwards and being capable of bending outwards away from each other, said flexible parts being made in continuation of the opposing side panels of the ridge member, and wherein the flexible parts have a thickness smaller than a thickness of the opposing panels so that the flexible parts are less rigid and more flexible than the opposing side panels.

10. A ventilating device according to claim 8, wherein the ventilating device further comprises flexible parts extending from lower edges of the ridge member downwards and being capable of bending outwards away from each other, said flexible parts being provided with ribs that weaken the flexible parts so that the flexible parts are less rigid and more flexible than the opposing side panels.

11. A ventilating device according to claim 1, wherein the flexible parts have lower edges provided with a flap extending downwards and being provided for establishing a substantially water tight abutment between the lower edge of the flexible parts and an underlying surface which the flexible parts are intended for abutting.

12. A ventilating device according to claim 1, wherein mounting means, co-operative with the ridge member, are provided for mounting of a ridge coping.

13. A ventilating device according to claim 12, wherein the mounting means comprises plugs configured for co-operating with and being secured to the ventilating passages established in the ridge member, and where each of the plugs is provided with means for mounting of the ridge coping to the mounting plug and thereby securing the ridge coping to the plug.

14. A ventilating device according to claim 12, wherein the mounting means comprises mounting clips configured for mounting in a groove provided in the top part of the ridge member and being provided with means for securing the clips to the groove, and where each of the mounting clips is provided with means for securing of a ridge coping to the mounting clip, thereby securing the ridge coping to the ventilating device.

15. A ventilating device according to claim 12, wherein the mounting means comprises mounting plates configured for mounting in a groove provided in the top part of the ridge member and being intended for being secured to the groove, and where each of the mounting plates is configured for co-operating with fastening means for securing of a ridge coping to the mounting clip, thereby securing the ridge coping to the ventilating device.

16. A ventilating device according to claim 14, wherein each of the mounting clips comprises a loop for securing a rear end of one roof tile and a front end of another roof tile to the mounting clip, and where each mounting clip also comprises legs with guiding sections intended for engaging with a dove-tail groove in the top of the ridge member.

17. A ventilating device according to claim 16, wherein each of the legs comprises means for securing the leg to the dove-tail groove, said means including an end engageable with a lateral side of the groove.

18. A ventilating device according to claim 17, wherein the means for securing the leg comprises a toggle joint like bend between a leg and a transverse legging.

19. A ventilating device according to claim 1, further comprising a connecting piece comprising two oppositely opposed ends having a cross section corresponding to a cross section of a canal formed between longitudinally extending cross pieces of the ridge member, said connecting piece having holes configured for extending in extension of holes provided in the cross pieces.

20. A ventilating device according to claim 1, further comprising a connecting piece comprising two oppositely opposed ends having a cross section corresponding to a cross section of a canal formed between longitudinally extending cross pieces of the ridge member, said connecting piece including wedge like bodies configured for engaging with holes provided in the cross pieces.

21. A ventilating device according to 8, wherein a band is stretched between a rafter of a roof construction that the ventilating device is to be mounted to, wherein part of a non-rigid underroof is supported by the band, and wherein the flexible parts of the ventilating device abut the underroof at least where the band supports the roof.

22. A ventilating device according to claim 1, wherein the ridge member is manufactured by extrusion and is made of plastic.

* * * * *

UNITED STATES PATENT AND TRADEMARK OFFICE

CERTIFICATE OF CORRECTION

PATENT NO. : 6,773,341 B2
DATED : August 10, 2004
INVENTOR(S) : Christian Cedergreen et al.

It is certified that error appears in the above-identified patent and that said Letters Patent is hereby corrected as shown below:

Column 2,
Line 60, the word “materiel” should read as -- material --.

Column 3,
Line 12, the word “y” should read as -- by --.
Lines 37-38, the word “in stead” should read as -- instead --.
Line 54, the word “form” should read as -- from --.
Line 66, the word “materiel” should read as -- material --.

Column 4,
Line 11, the word “underrroof” should read as -- underroof --.

Column 5,
Line 63, the phrase “In 35 the” should read as -- In the --.

Column 6,
Line 15, the phrase “mm 10” should read as -- 10 mm --.

Column 7,
Line 65, the word “rawplug®” should read as -- rawlplug® --.

Column 8,
Line 29, the word “en” should read as -- and --.

UNITED STATES PATENT AND TRADEMARK OFFICE

CERTIFICATE OF CORRECTION

PATENT NO. : 6,773,341 B2
DATED : August 10, 2004
INVENTOR(S) : Christian Cedergreen et al.

It is certified that error appears in the above-identified patent and that said Letters Patent is hereby corrected as shown below:

Coulmn 9,
Lines 58-59, the phrase “shown in also” should read as -- shown in the drawings also --.

Column 11,
Line 14, the phrase “not not” should read as -- not --.

Column 14,
Line 41, the word “roof” should read as -- underroof --.

Signed and Sealed this

Eighteenth Day of October, 2005

JON W. DUDAS
*Director of the United States Patent and Trademark Office*